US006970137B1

(12) United States Patent
Maslovski et al.

(10) Patent No.: US 6,970,137 B1
(45) Date of Patent: Nov. 29, 2005

(54) METHOD AND DEVICE FOR LOADING PLANAR ANTENNAS

(75) Inventors: Stanislav Maslovski, St. Petersburg (RU); Pekka Ikonen, Espoo (FI); Vasil Denchev, Espoo (FI); Sergei Tretyakov, Espoo (FI); Igor Kolmakov, St. Petersburg (RU)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/869,494

(22) Filed: Jun. 15, 2004

(51) Int. Cl.[7] ..... H01Q 1/24; H01Q 1/38
(52) U.S. Cl. ..... 343/702; 343/700 MS
(58) Field of Search ..... 343/702, 700 MS

(56) References Cited

U.S. PATENT DOCUMENTS

| | | | | |
|---|---|---|---|---|
| 6,437,747 | B1 * | 8/2002 | Stoiljkovic et al. | 343/702 |
| 6,448,932 | B1 * | 9/2002 | Stoiljkovic et al. | 343/700 MS |
| 6,650,295 | B2 * | 11/2003 | Ollikainen et al. | 343/700 MS |
| 6,774,849 | B2 * | 8/2004 | Umehara et al. | 343/700 MS |
| 2002/0190906 | A1 * | 12/2002 | Kim et al. | 343/702 |
| 2003/0001794 | A1 * | 1/2003 | Park et al. | 343/895 |

OTHER PUBLICATIONS

Electronics Letters, vol. 31, No. 20; Hwang et al.; "Planar inverted F antenna loaded with high permittivity material"; pp. 1710-1712; Sep. 28, 1995.
IEEE 0-7803-7070-8/01; Rahman et al.; "Wide-Band Microstrip Patch Antenna with Planar PBG Structure"; pp. 486-489; 2001.
IEEE 0-7803-4178-3/97; Rauth et al.; "Broadband, Low-profile Antenna for Portable Data Terminal", pp. 438-441; 1997.
Microwave and Optical Technology Letters, Vo. 33, No. 6; Hsiao et al.; "Compact Planar Inverted-F-Patch Antenna for Triple-Frequency Operation"; pp. 459-462; Jun. 20, 2002.
IEEE Transactions on Antennas and Propagation, vol. 48, No. 8, 0018-926X/00; Salonen et al.; "Single-Feed Dual-Band Planar Inverted-F Antenna with U-Shaped Slot"; pp. 1262-1264; Aug. 2000.
IEEE Transactions on Antennas and Propagation, vol. 45, No. 5, 0018-926x/97; Rowell et al.; "A Capacitively Loaded PIFA for Compact Mobile Telephone Handsets"; pp. 837-842; May 1997.
IEEE Transactions on Antennas and Propagation, vol. 49, No. 7, 0018-926x/01; Lui et al.; "Compact Dual-Frequency PIFA Designs Using LC Resonators"; pp. 1016-1019; Jul. 2001.
Proceedings of the IEEE, vol. 80, No. 1, 0018-9219/92; D. Pozar; "Microstrip Antennas"; pp. 79-91.
IEEE Transactions on Microwave Theory and Techniques, vol. 47, No. 11, 0018-9480/99; Pendry et al.; "Magnetism from Conductors and Enhanced Nonlinear Phenomena"; pp. 2075-2084, Nov. 1999.
The American Physical Society, Physical Review B., vol. 65; Marqués et al.; "Role of bianisotropy in negative permeability and left-handed metamaterials"; pp. 144440-1-14444-6; 2002.
Helsinki University of Technology; Ikonen et al.; "New artificial high-permeability material for microwave applications"; pp. 1-4.

* cited by examiner

*Primary Examiner*—Tan Ho
(74) *Attorney, Agent, or Firm*—Ware, Fressola, Van Der Sluys & Adolphson LLP

(57) ABSTRACT

In an RF antenna having a planar radiating element disposed adjacent to a ground plane, one or more metasolenoids are disposed between the radiating element and the ground plane. As such, the magnetic flux through the metasolenoids interacts with the radiating element and the ground plane, widening the bandwidth of the antenna. Each of the metasolenoid comprises a stack of split-ring resonators co-axially aligned. The gap in each split-ring resonator is oriented differently from the gap in the adjacent split-ring resonator. The use of metasolenoids disposed between the radiating element and the ground plane does not increase the volume of the radiating element.

20 Claims, 6 Drawing Sheets

METHOD AND DEVICE FOR LOADING PLANAR ANTENNAS

FIELD OF THE INVENTION

The present invention relates to the loading of RF antennas and, more particularly, to the bandwidth enhancement of planar inverted-F antennas.

BACKGROUND OF THE INVENTION

Mobile phones require a small antenna for signal transmission and reception. Microstrip antennas, including planar inverted-F antennas (PIFAs), are, in general, suitable for that purpose. One of the known features of microstrip antennas is a narrow bandwidth they possess. Several different techniques for widening the bandwidth of PIFAs have been used or proposed. For example, the bandwidth of a PIFA can be altered by changing the size and the shape of the patch. Bandwidth widening can also be achieved by using parasitic patches disposed adjacent to the radiator. Different materials such as dielectrics of photonic bandgap structures (PBGs) have been used to load the radiator. In most cases, implementing the bandwidth widening feature increases the cost of antennas significantly or the volume of the antenna radiator.

It is advantageous and desirable to provide a method and device for efficiently widening the bandwidth of a PIFA in a hand-held electronic device without the disadvantages of the prior art techniques.

SUMMARY OF THE INVENTION

The present invention uses one or more metasolenoids disposed between the radiating element and the ground plane of a PIFA antenna to widen the bandwidth of the radiating element. Each of the metasolenoid comprises a stack of split-ring resonators co-axially aligned. The use of metasolenoids disposed between the radiating element and the ground plane does not increase the volume of the radiating element.

The first aspect of the present invention provides a method of increasing a bandwidth of an antenna disposed adjacent to a ground plane, the antenna comprising a radiating element, a grounding pin electrically connecting the radiating element to the ground plane and a feed spaced from the grounding pin. The method comprises:

arranging a plurality of electrically conductive rings in one or more stacks, each ring having a gap and a ring axis, wherein in each of said one or more stacks the electrically conductive rings are aligned along the ring axes, with each ring adjacent to an adjacent ring having a space therebetween; and disposing one or more stacks of the electrically conductive rings between the radiating element and the ground plane.

According to the present invention, the gap of the ring is oriented differently from the gap of the adjacent ring.

According to the present invention, the ring axes are substantially parallel to the radiating element, but the ring axes in one stack can be the substantially the same as or different from the ring axes in other of said one or more stacks.

The second aspect of the present invention provides a loading device for use in an antenna comprising a radiating element disposed adjacent to a ground plane, a grounding pin electrically connecting the radiating element to the ground plane and a feed spaced from the grounding pin, the device disposed between the radiating element and the ground plane for loading the antenna. The loading device comprises:

a plurality of electrically conductive rings, each ring having a gap and a ring axis, wherein the electrically conductive rings are arranged such that each ring is in a close proximity of an adjacent ring having a space therebetween, and that the ring axis of each ring is substantially aligned with the ring axis of another ring; and an electrically non-conductive material disposed between the space between two adjacent rings.

According to the present invention, the device is disposed such that the ring axes are substantially parallel to the radiating element.

The third aspect of the present invention provides an RF antenna for use in a communications device having a ground plane. The antenna comprises:

a radiating element disposed adjacent to the ground plane, a grounding pin electrically connecting the radiating element to the ground plane;

a feed electrically connecting the radiating element, spaced from the grounding pin, and one or more loading components disposed between the radiating element and the ground plane, wherein each of said one or more loading components comprises a plurality of electrically conductive rings, each ring having a gap and a ring axis, and wherein the electrically conductive rings are arranged such that each ring is in a close proximity of an adjacent ring having a space therebetween, and that the ring axis of each ring is substantially aligned with the ring axis of another ring.

According to the present invention, the radiating element is a planar piece of electrically conductive material, and the ring axes are substantially parallel to the radiating element.

The fourth aspect of the present invention provides a communications device, which comprises:

a ground plane;

an antenna for conveying communications signals to and from other communications device, wherein the antenna comprises a radiating element adjacent to the ground plane, a radiating element disposed adjacent to the ground plane, a grounding pin electrically connecting the radiating element to the ground plane, and a feed electrically connecting the radiating element, spaced from the grounding pin; and one or more loading components disposed between the radiating element and the ground plane, wherein each of said one or more loading components comprises a plurality of electrically conductive rings, each ring having a gap and a ring axis, and wherein the electrically conductive rings are arranged such that each ring is in a close proximity of an adjacent ring having a space therebetween, and that the ring axis of each ring is substantially aligned with the ring axis of another ring.

The present invention will become apparent upon reading the description taken conjunction with FIGS. 1–6.

DETAILED DESCRIPTION OF THE INVENTION

Figure 1:
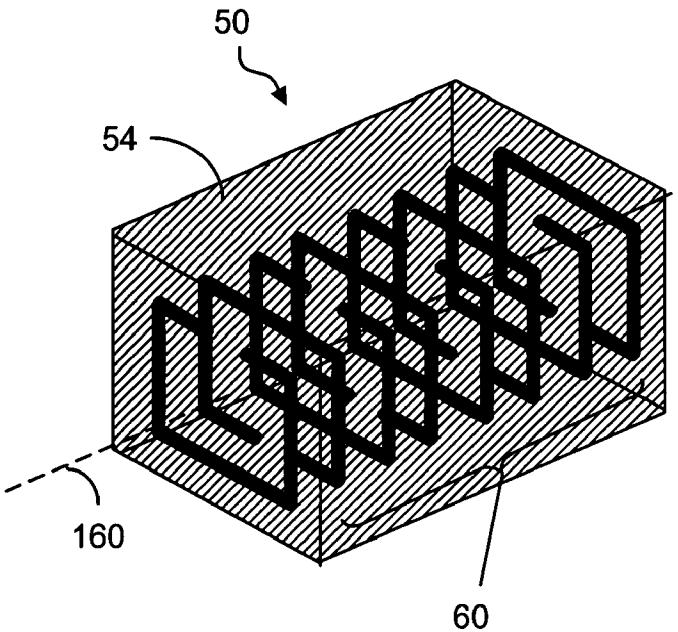
FIG. 1 is a schematic representation showing the loading element.
Figure 3A:
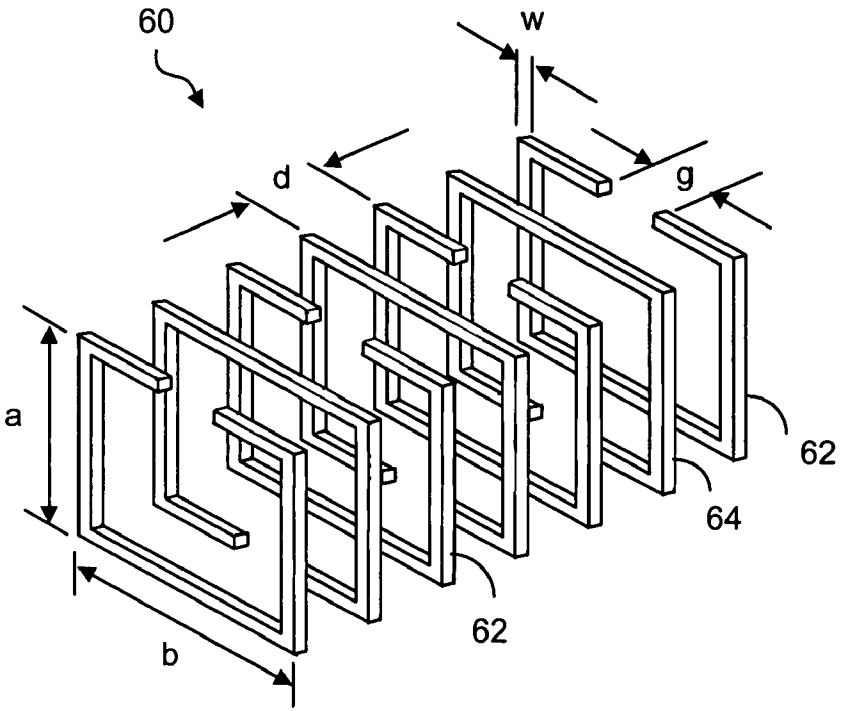
FIG. 3*a* is a schematic representation showing a stack of split-ring resonators for use in the loading element.
Figure 2:
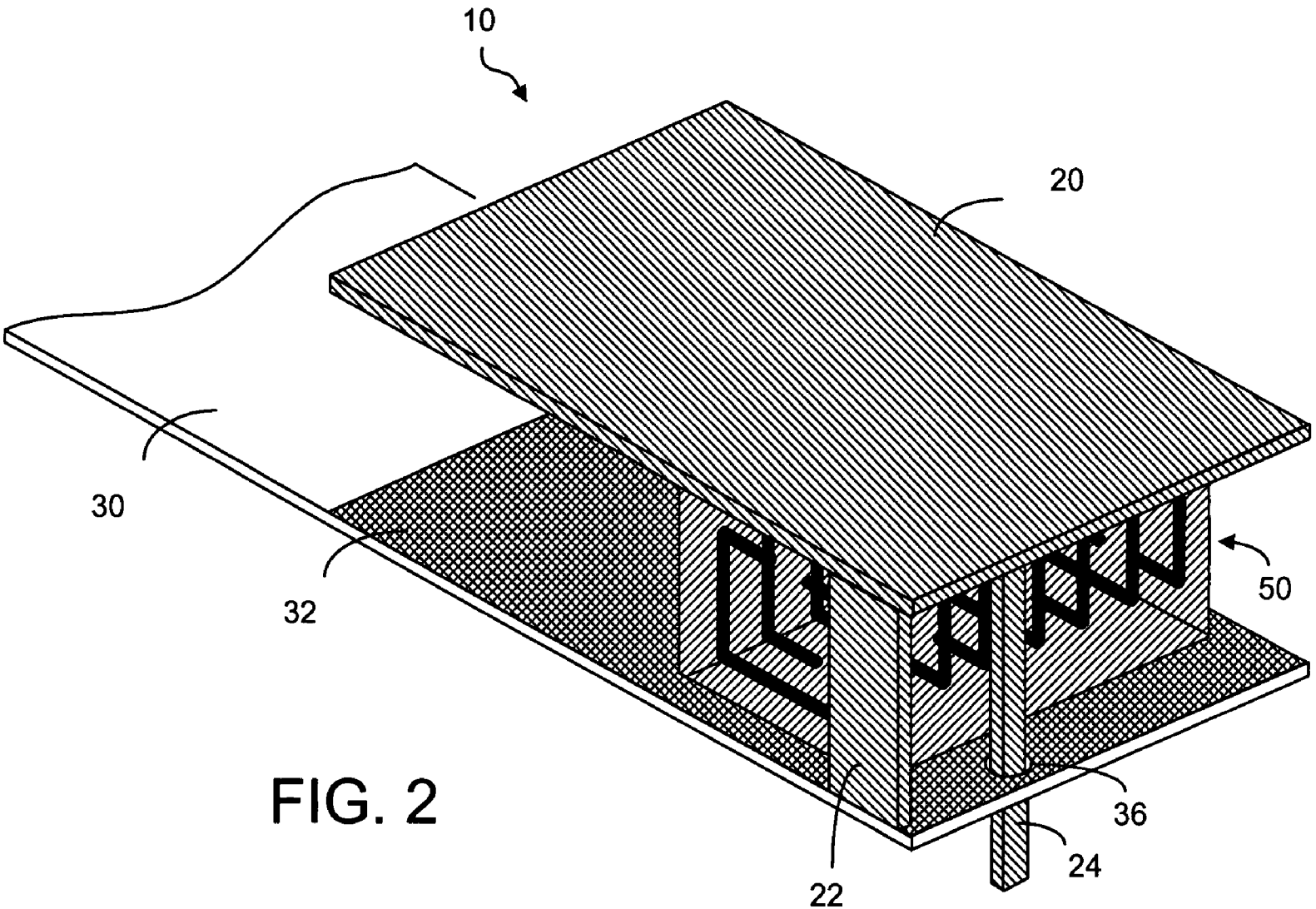
FIG. 2 is a schematic representation showing a PIFA with a loading element, according to the present invention.

The loading element for use in widening the bandwidth of a PIFA, according to the present invention, is a metasolenoid, as shown in FIG. 1. The metasolenoid is used as an added-on magnetic resonator for loading the PIFA. With a suitable coupling between the antenna elements and the magnetic resonator, the electrical parameters of the antenna can be controlled in a wider range. As shown in FIG. 2, the antenna 10, of the present invention, comprises a radiating element 20 disposed adjacent to a substrate 30. A grounding pin 22 electrically connected between the radiating element 20 and a ground plane 32 on the substrate 30 for providing the short-circuit function. A feeding pin 24 is disposed adjacent to the grounding pin 22 through an aperture 36 on the substrate 30 and the ground plane 32. The structure of a PIFA is known in the art.

In order to widen the bandwidth of the PIFA, a loading element 50 is disposed between the ground plane 32 and the radiating element 20, so that the magnetic flux through the metasolenoid efficiently interacts with the radiating element 20 and the ground plane 32. As shown in FIG. 2, using a metasolenoid for loading the PIFA does not increase the volume of the radiating element.

Figure 3C:
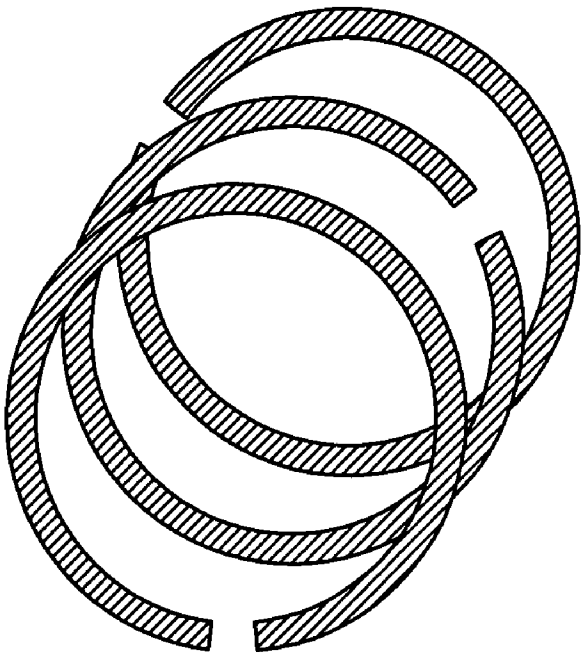
FIG. 3*c* is a schematic representation showing a stack of split-ring resonators having a circular shape, wherein the gap of the ring is oriented substantially at 120 degrees from the gap of the adjacent ring.
Figure 3B:
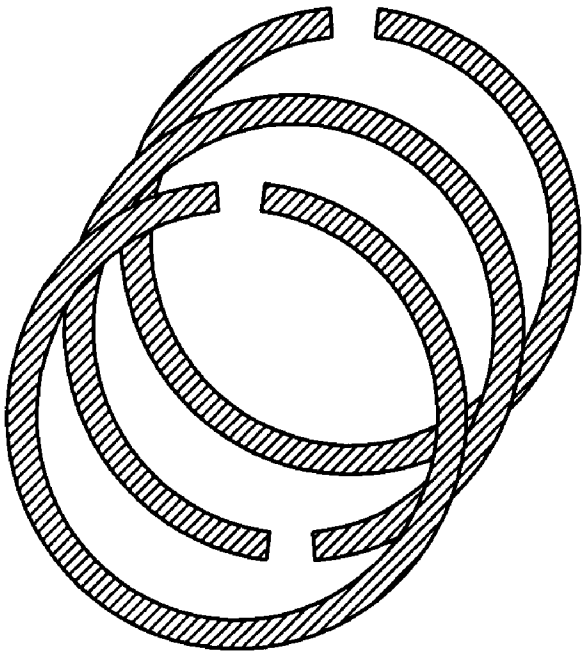
FIG. 3*b* is a schematic representation showing a stack of split-ring resonators having a circular shape, wherein the gap of the ring is oriented opposite to the gap of the adjacent ring.

As shown in FIGS. 1 to 3*c*, the loading element 50 comprises a metasolenoid 60, embedded or otherwise disposed in a block of dielectric material 54. The metasolenoid 60 comprises a stack of split-ring resonators (SRRs) 62 and 64, co-axially aligned Each of the SRRs has a gap g. As shown, the SRR 62 and SRR 64 are identical except that their gaps face different directions. The SRRs 62, 64 are alternatively placed along a ring axis 160, spaced apart with a distance d between two adjacent SRRs. In an embodiment of the present invention, the SRRs are rectangular in shaped, with a side length of a, a base width of b and a ring width of w, as shown in FIG. 3*a*. However, the SSRs can have a different shape, such as circular, as shown in FIG. 3*b*. The orientation of the gap in an SSR can be opposite to the gap in an adjacent SSR, as shown in FIGS. 3*a* and 3*b*. However, the orientation of the gap in relation to the gap in the adjacent SSR can be different, as shown in FIG. 3*c*.

Figure 4:
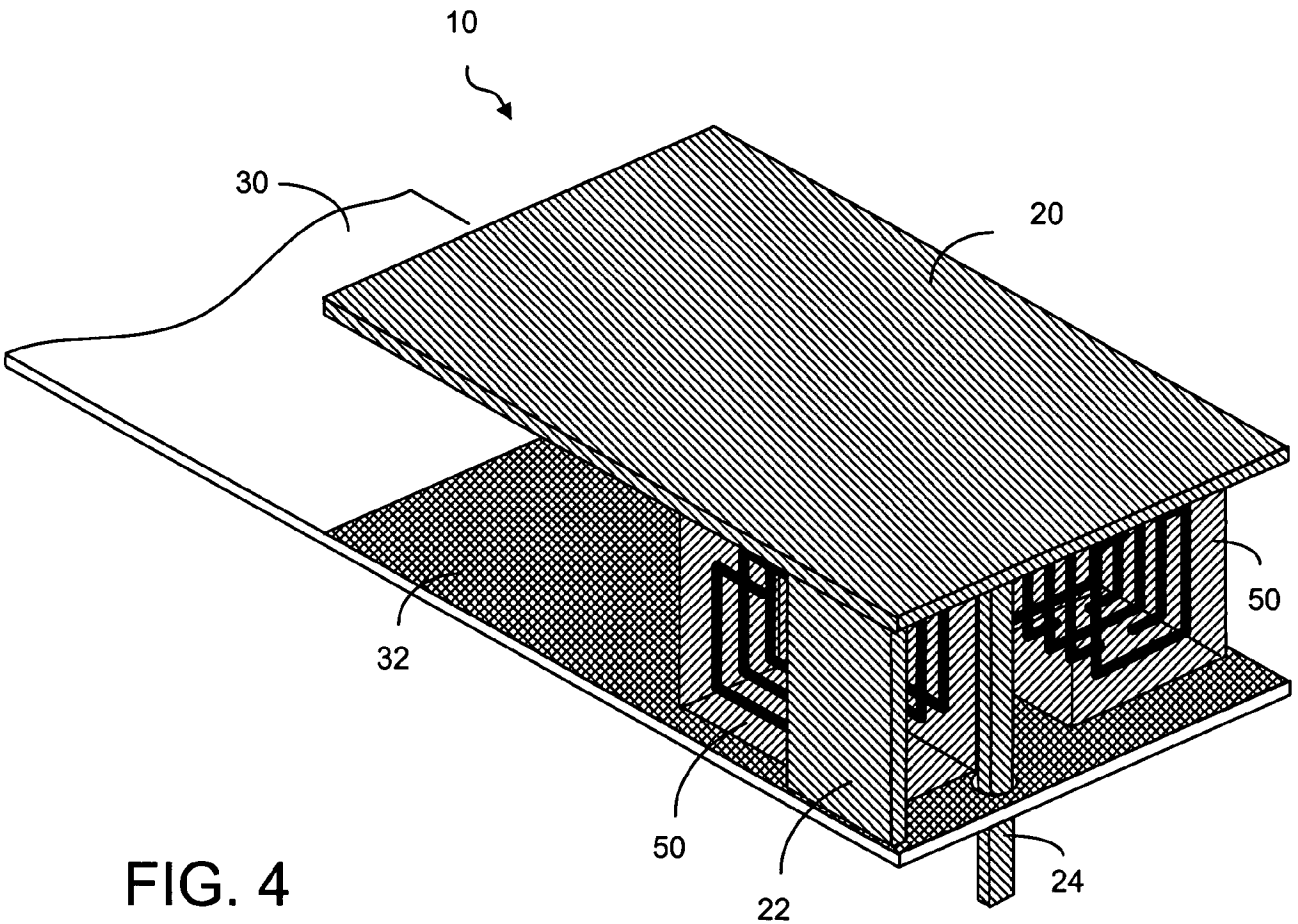
FIG. 4 is a schematic representation showing another embodiment of the antenna, according to the present invention.

A measurement has been made to demonstrate the loading effect of a PIFA using two metasolenoids 60, as shown in FIG. 4. In particular, in order to remove the effect of the chassis used in the measurement to the radiation characteristics, the ground plane used in the measurement is 30×30 $cm^2$. The size of the radiating element is 20×40 $mm^2$. The width of the grounding pin is 5 mm and the distance between the radiating element and the ground plane is 6.5 mm. The number of SRRs in each metasolenoid, in this measurement setup, is approximately 60 to 70. The dimensions of SRRs are given below:

a=b=3.5 mm
w=0.4 mm
g=1.0 mm
d=0.127 mm
permittivity of the embedding material is 2.20−0.001j.

Figure 5:
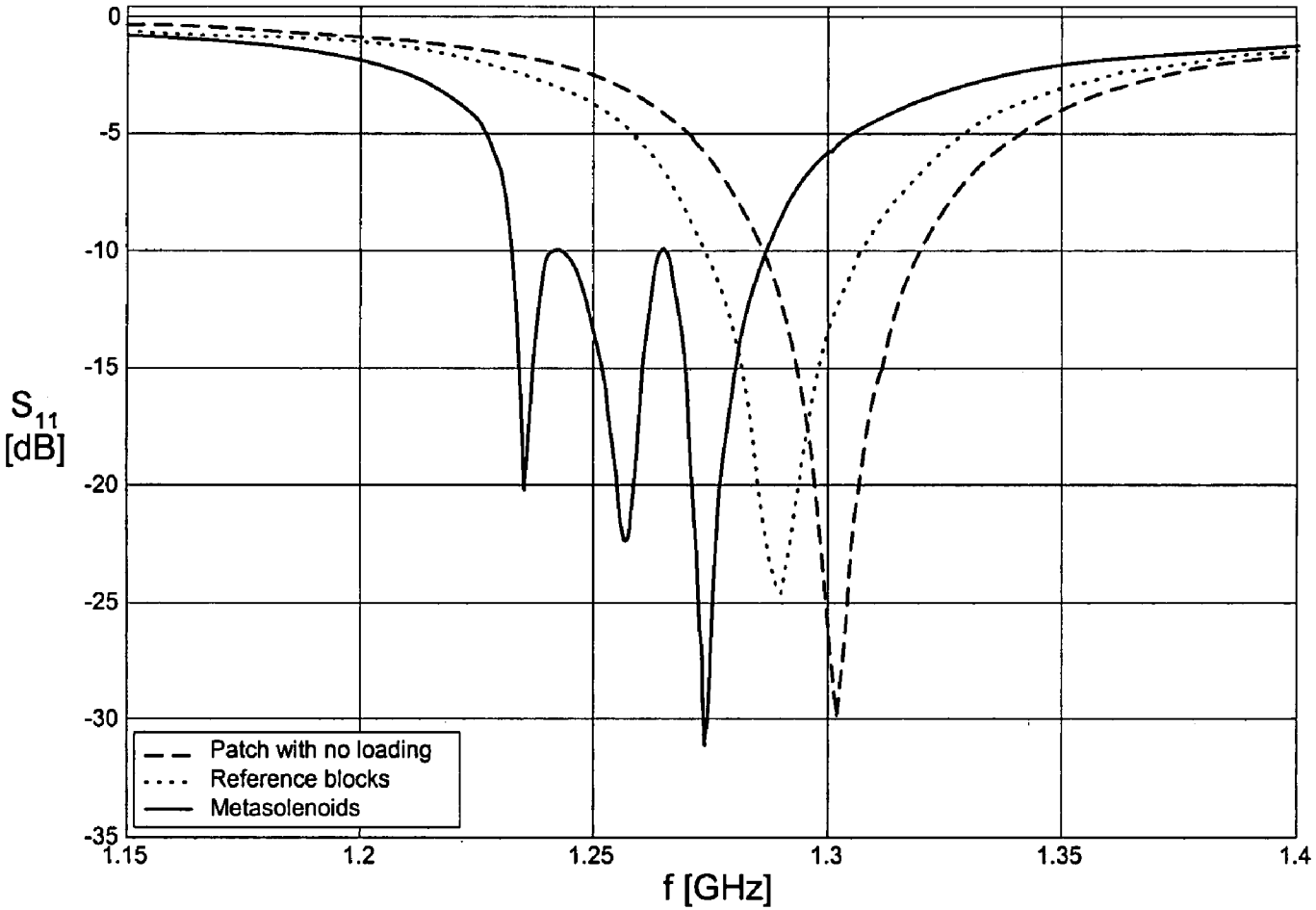
FIG. 5 is a frequency response showing the measurement results on a PIFA with and without loading using the loading element of the present invention.

The measurement result is shown in FIG. 5. A significant increase in the bandwidth is evidenced. As shown in FIG. 1, the $S_{11}$ curve measured when no loading is used has only one deep minimum, corresponding substantially to the resonant frequency of the PIFA. The $S_{11}$ curve measured when two metasolenoids are used for loading exhibits three deep minimums, corresponding substantially to the resonant frequencies of the two metasolenoids and that of the radiating element. When the metasolenoids are designed in a way that their resonant frequencies are close to the resonant frequency of the PIFA, by proper adjustment of the metasolenoids under the radiating element, the magnetic flux created by the PIFA excites the metasolenoids. By adjusting the resonant characteristics of the metasolenoids relative to the resonant frequency of the PIFA, one can adjust the widening of the bandwidth of the structure.

Figure 6:
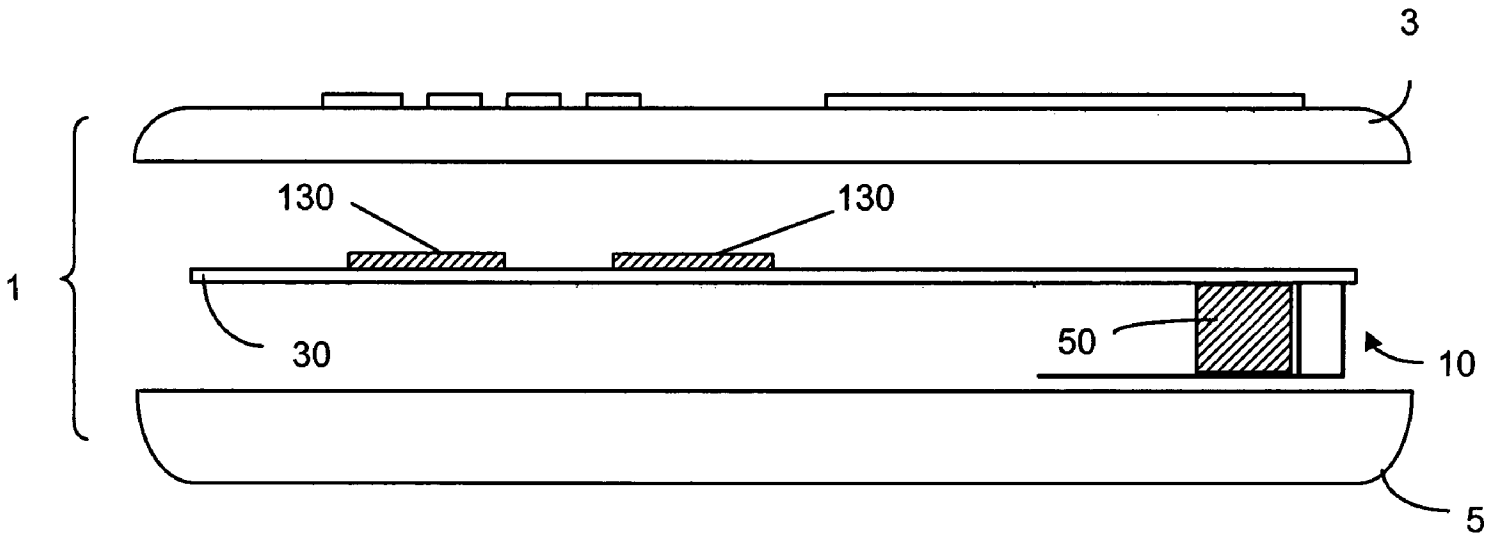
FIG. 6 is a schematic representation showing a hand-held electronic device having an enhanced PIFA, according to the present invention.

The PIFA loaded with one or more loading elements 50, according to the present invention, can be used in a communications device, such as a mobile terminal, a communicator device and the like. FIG. 6 is a schematic representation showing a communications device 1. The device 1 comprises an upper housing part 3 and a lower housing part 5 to implement a printed circuit board (PCB) or a printed-wire board (PWB), which has a substrate 30 for mounting an antenna 10 loaded with one or more loading elements 50. The communications device 1 further comprises a plurality of electronic components 130, which may includes an RF-front end operatively connected to the antenna 50.

It should be noted that when two or more loading elements are used for loading a PIFA antenna, as shown in FIG. 4, the ring axes 160 (see FIG. 1) are oriented differently. As shown in FIG. 4, the ring axes of one loading element 50 is substantially perpendicular to the ring axes of the other loading element 50. However, the loading elements can be co-axially aligned, for example, or they can be arrangement in a different way while keeping the ring axes substantially parallel to the radiating element.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method of increasing a bandwidth of an antenna disposed adjacent to a ground plane, the antenna comprising a radiating element, a grounding pin electrically connecting the radiating element to the ground plane and a feed spaced from the grounding pin, said method comprising:

arranging a plurality of electrically conductive rings in one or more stacks, each ring having a gap and a ring axis, wherein in each of said one or more stacks the electrically conductive rings are aligned along the ring axes, with each ring adjacent to an adjacent ring having a space therebetween; and disposing one or more stacks of the electrically conductive rings between the radiating element and the ground plane.

2. The method of claim 1, wherein in each of said one or more stacks the gap of the ring is oriented differently from the gap of the adjacent ring.

3. The method of claim 1, wherein in each of said one or more stacks the gap of the ring is oriented opposite to the gap of the adjacent ring.

4. The method of claim 1, wherein the radiating element is a planar piece of electrically conductive material.

5. The method of claim 1, wherein the rings are substantially rectangular in shape.

6. The method of claim 1, wherein the rings are substantially circular in shape.

7. The method of claim 1, wherein the ring axes are substantially parallel to the radiating element.

8. The method of claim 7, wherein the ring axes in one stack is different from the ring axes in other of said one or more stacks.

9. The method of claim 7, wherein the ring axes in one stack is perpendicular to the ring axes in at least one of the other stacks.

10. A device for use in an antenna comprising a radiating element disposed adjacent to a ground plane, a grounding pin electrically connecting the radiating element to the ground plane and a feed spaced from the grounding pin, the device disposed between the radiating element and the ground plane for loading the antenna, said device comprising:

a plurality of electrically conductive rings, each ring having a gap and a ring axis, wherein the electrically conductive rings are arranged such that each ring is in a close proximity of an adjacent ring having a space therebetween, and that the ring axis of each ring is substantially aligned with the ring axis of another ring; and an electrically non-conductive material disposed between the space between two adjacent rings.

11. The device of claim 10, wherein the gap of the ring is oriented differently from the gap of the adjacent ring.

12. The device of claim 10, wherein the gap of the ring is oriented opposite to the gap of the adjacent ring.

13. The device of claim 10, wherein the device is disposed such that the ring axes are substantially parallel to the radiating element.

14. An RF antenna for use in a communications device having a ground plane, said antenna comprising:

a radiating element disposed adjacent to the ground plane, a grounding pin electrically connecting the radiating element to the ground plane;

a feed electrically connecting the radiating element, spaced from the grounding pin, and one or more loading components disposed between the radiating element and the ground plane, wherein each of said one or more loading components comprises a plurality of electrically conductive rings, each ring having a gap and a ring axis, and wherein the electrically conductive rings are arranged such that each ring is in a close proximity of an adjacent ring having a space therebetween, and that the ring axis of each ring is substantially aligned with the ring axis of another ring.

15. The antenna of claim 14, wherein in each of said one or more stacks the gap of the ring is oriented opposite to the gap of the adjacent ring.

16. The antenna of claim 14, wherein the radiating element is a planar piece of electrically conductive material, and the ring axes are substantially parallel to the radiating element.

17. The antenna of claim 16, wherein the ring axes in one stack is different from the ring axes in other of said one or more stacks.

18. The antenna of claim 16, wherein the ring axes in one stack is perpendicular to the ring axes in at least one of the other stacks.

19. A communications device comprising:

a ground plane;

an antenna for conveying communications signals to and from other communications device, wherein the antenna comprises a radiating element adjacent to the ground plane, a radiating element disposed adjacent to the ground plane, a grounding pin electrically connecting the radiating element to the ground plane, and a feed electrically connecting the radiating element, spaced from the grounding pin; and one or more loading components disposed between the radiating element and the ground plane, wherein each of said one or more loading components comprises a plurality of electrically conductive rings, each ring having a gap and a ring axis, and wherein the electrically conductive rings are arranged such that each ring is in a close proximity of an adjacent ring having a space therebetween, and that the ring axis of each ring is substantially aligned with the ring axis of another ring.

20. The communications device of claim 19, wherein the gap of the ring is oriented differently from the gap of the adjacent ring.

* * * * *